US005709178A

United States Patent [19]

Feucht

[11] Patent Number: 5,709,178

[45] Date of Patent: Jan. 20, 1998

[54] ELECTRONICALLY CONTROLLED OUTWARDLY OPENING VALVE SYSTEM FOR AN ENGINE

[75] Inventor: Dennis D. Feucht, Morton, Ill.

[73] Assignee: Caterpillar Inc., Peoria, Ill.

[21] Appl. No.: 813,558

[22] Filed: Mar. 7, 1997

Related U.S. Application Data

[63] Continuation-in-part of Ser. No. 635,799, Apr. 22, 1996, Pat. No. 5,615,646, and Ser. No. 767,746, Dec. 17, 1996, Pat. No. 5,694,893.

[51] Int. Cl.[6] ..... F01L 9/02; F01L 9/04

[52] U.S. Cl. ..... 123/90.12; 123/90.11; 123/90.24

[58] Field of Search ..... 123/90.11, 90.12, 123/90.13, 90.14, 90.24

[56] References Cited

U.S. PATENT DOCUMENTS

| | | | |
|---|---|---|---|
| 1,129,393 | 2/1915 | Huff | 123/76 |
| 1,405,597 | 2/1922 | Kirby | 123/90.47 |
| 1,491,023 | 4/1924 | Belden | 123/90.27 |
| 1,539,227 | 5/1925 | Wood | 123/65 VB |
| 1,695,011 | 12/1928 | Fornaca | 123/90.49 |
| 1,914,340 | 6/1933 | Holzwarth | 123/41.41 |
| 1,965,517 | 7/1934 | Vitalini | 123/90.12 |
| 2,552,006 | 5/1951 | Gill, Jr. | 123/65 VB |
| 2,954,017 | 9/1960 | Forstner | 123/90.16 |
| 3,430,614 | 3/1969 | Meacham | 123/90.24 |
| 4,502,426 | 3/1985 | Skelley | 123/90.15 |
| 5,531,192 | 7/1996 | Feucht et al. | 123/90.12 |
| 5,636,602 | 6/1997 | Meister | 123/90.12 |

FOREIGN PATENT DOCUMENTS 512113 1/1955 Italy .

*Primary Examiner*—Weilun Lo
*Attorney, Agent, or Firm*—Liell & McNeil

[57] ABSTRACT

An outwardly opening valve system for an engine includes an actuator body having a guide bore, a fluid cavity filled with hydraulic fluid that opens to a valve plunger bore, an intensifier plunger bore and a re-supply passageway. A check valve positioned in the re-supply passageway is operable to prevent back flow of hydraulic fluid from the fluid cavity. An outward valve member with a valve face is positioned to reciprocate in the guide bore. An intensifier plunger is slidably positioned in the intensifier plunger bore. A valve plunger is slidably positioned in the valve plunger bore. An over center cam mechanism includes a cam mounted to the actuator body and rotatable about a pivot pin, a push rod with one end in contact with the cam and an other end in contact with the outward valve member, and finally the pivot pin is attached to the valve plunger. A solenoid is mounted on the actuator body and includes a control rod. A computer is in communication with and capable of controlling the solenoid.

20 Claims, 4 Drawing Sheets

ELECTRONICALLY CONTROLLED OUTWARDLY OPENING VALVE SYSTEM FOR AN ENGINE

Relation to Other Patent Applications

This application is a continuation-in-part of co-pending application Ser. No. 08/635,799, filed Apr. 22, 1996, and entitled METHOD AND APPARATUS FOR HOLDING A CYLINDER VALVE CLOSED DURING COMBUSTION, (now U.S. Pat. No. 5,615,646), which is a CIP of Ser. No. 08/767,746 filed Dec. 12, 1996, now U.S. Pat. No. 5,694,893.

TECHNICAL FIELD

The present invention relates generally to outwardly opening valves for internal combustion engines, and more particularly to a mechanism for opening and closing outwardly opening cylinder valves for an engine.

BACKGROUND ART

In the past, almost all engines utilized inwardly opening valves to permit the exchange of gases with the engine's hollow piston cylinders between each combustion event. The valve member typically includes an enlarged portion with an annular valve face that is positioned within the hollow piston cylinder, and a stem attached to the enlarged portion that protrudes away through the opening connecting the cylinder to a gas passageway. During combustion, these valve members are held against their seats by the high pressure differential existing across the valve opening during combustion. In most cases, these types of valves are pushed open between combustion events by a cam that is driven directly by the engine. While these types of cam driven inwardly opening valves have performed well over many years, the current trend toward electronically controlled valves may render the inwardly opening valves of the prior art unsuitable.

In the case of diesel engines, the timing of valve opening with the movement of the piston in its cylinder is critical because the piston and valve members must necessarily occupy the same space within the hollow piston cylinder, only at different times. Although valve to piston contact is a possibility with prior art cam driven systems, it rarely occurs because the mechanical interconnection of the various components makes such contact extremely unlikely. In the case of electronically controlled and actuated valve members, piston contact is much more likely because there is no mechanical interconnection. In other words, potentially catastrophic valve to piston contact can occur simply because of an erroneous open command produced by the engine computer due to software errors and/or erroneous sensor inputs to the computer. Thus, the real and perceived danger of valve to piston contact with electronically actuated and controlled valves has hindered movement in the industry to a camless engine that is completely electronically actuated and controlled.

One method of avoiding the possibility of valve to piston contact is to utilize outwardly opening valves that are actually positioned outside the hollow piston cylinder, and therefore do not have the possibility of valve to piston contact. However, outwardly opening valves have never been successfully implemented into diesel engines on a large scale because of the great difficulty in holding such valve members closed during the high pressures produced by combustion. In those cases where outwardly opening valves have been successfully utilized, the actuation system utilized to both hold the valve closed, and open the valve at desired times, often requires large amounts of energy, which again renders such a system less than desirable.

The present invention is directed to overcoming one or more of the problems as set forth above.

DISCLOSURE OF THE INVENTION

In one embodiment, an outwardly opening valve system includes an engine having a hollow piston cylinder in fluid communication with a gas passageway via an opening, and an intensifier bore that opens to the hollow piston cylinder. The opening includes an outward valve seat adjacent the gas passageway. An outward valve member with a valve face is positioned adjacent the valve seat. An intensifier piston is positioned in the intensifier piston bore with one end contacting gas within the hollow piston cylinder. A coupling linkage interconnects the intensifier piston and the outward valve member, and includes an over center cam mechanism with a cam. The cam is rotatable between a closed position in which the valve face of the outward valve member is positioned against the valve seat closing the opening and an open position in which the valve face is away from the valve seat. A force generating device, such as a solenoid, is attached to the engine and has a control rod in contact with the cam over a portion of the cam's rotation between its closed position and its open position.

In another embodiment, an outward opening valve system for an engine includes an actuator body having a fluid cavity filled with hydraulic fluid that opens to a valve plunger bore, an intensifier plunger bore, and a re-supply passage. A valve is positioned in the re-supply passage and is operable to prevent back flow of hydraulic fluid from the fluid cavity into the re-supply passageway. An outward valve member with a valve face is positioned to reciprocate in the actuator body. An intensifier plunger is slidably positioned in the intensifier plunger bore with one end in contact with the hydraulic fluid in the fluid cavity and an other end attached to the intensifier piston. A valve plunger is slidably positioned in the valve plunger bore with one end in contact with the hydraulic fluid and an other end in contact with an over center cam mechanism. The over center cam mechanism includes a cam mounted to the actuator body and rotatable about a pivot pin, and a push rod with one end in contact with the cam and an other end in contact with the outward valve member. The pivot pin is attached to the valve plunger. A force generating device, such as a solenoid, is mounted on the actuator body and has a control rod. The solenoid is capable of moving the control rod between a first position in contact with the cam and a second position away from the cam. A computer is in communication with and capable of controlling the force generating device.

BEST MODE FOR CARRYING OUT THE INVENTION

Figure 1:
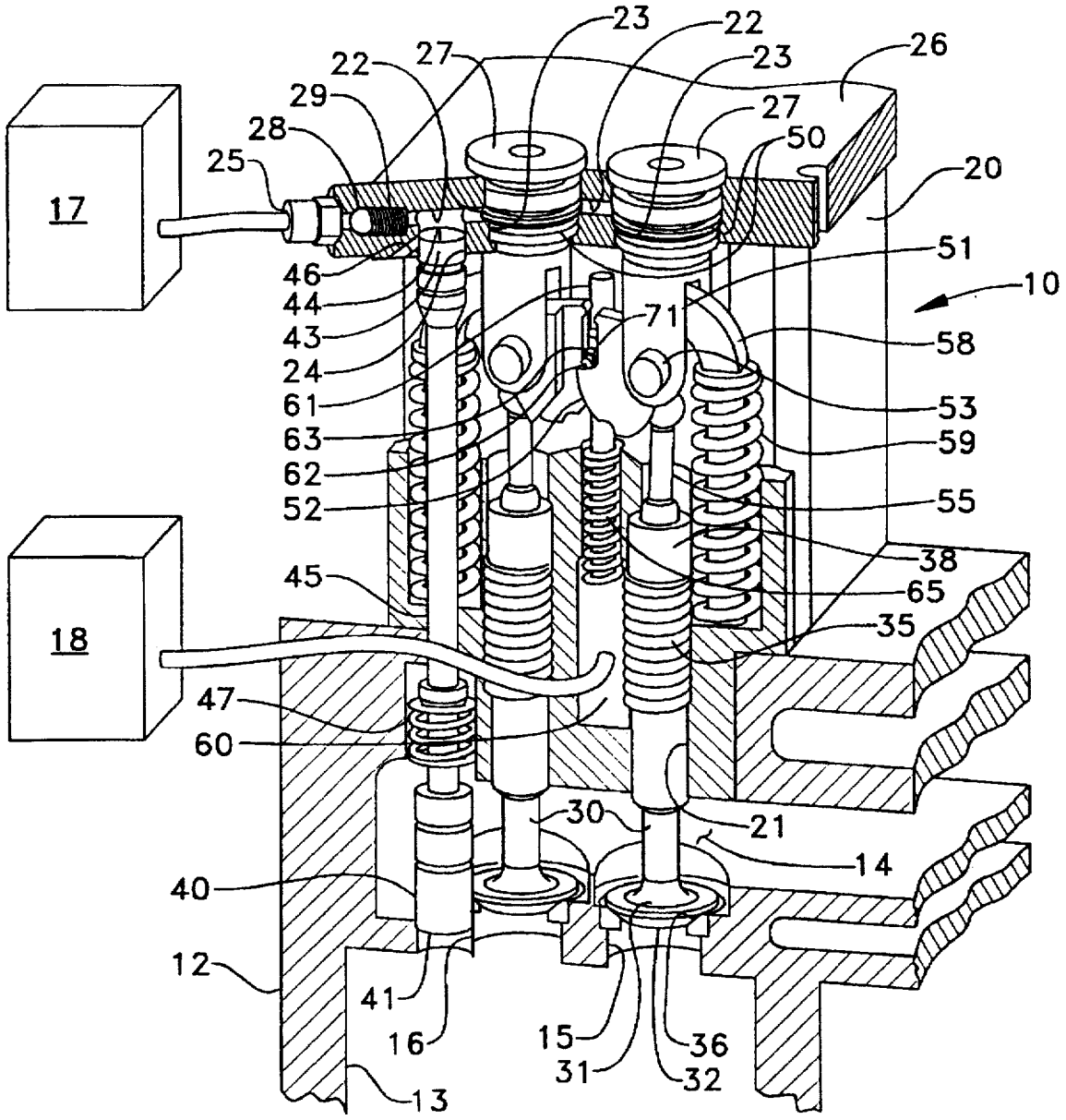
FIG. 1 is a partial sectioned isometric view of an outwardly opening valve system according to the present invention.

Referring now to FIG. 1, an outwardly opening valve mechanism 10 is mounted on an engine 12 having a hollow piston cylinder 13 in fluid communication with a gas passageway 14 via an opening 15. Engine 12 also includes a piston bore 16 that opens to the hollow piston cylinder 13. Opening 15 includes an outward valve seat 36 adjacent gas passageway 14. Outward valve seat 36 can be a floating annular valve seat which is biased away from hollow piston cylinder 13 by a compression spring. An intensifier piston 40 is slidably positioned in piston bore 16 with one end 41 contacting gas within hollow piston cylinder 13. Mechanism 10 includes a pair of outward valve members 30, each with an enlarged head portion 31 that includes an annular valve face 32. When annular valve face 32 is seated in outward valve seat 36, opening 15 is closed.

A coupling linkage interconnects intensifier piston 40 with outward valve members 30, and includes an over center cam mechanism. The coupling linkage is supported by an actuator body 20 that includes a hold down pressure plate 26. Actuator body 20 defines a fluid cavity 22 filled with a hydraulic fluid and opening to a valve plunger bore 23, an intensifier plunger bore 24, a bleed off passage 46, and a re-supply passage 25. A check valve 28 is positioned in re-supply passage 25 and is operable by the action of compression spring 29 to prevent back flow of hydraulic fluid from fluid cavity 22 into re-supply passage 25. Re-supply passage 25 is connected to a relatively high pressure source 17 of hydraulic fluid, such as engine lubricating oil. An intensifier plunger 43 is slidably positioned in intensifier plunger bore 24 and has one end 44 in contact with the hydraulic fluid in fluid cavity 22 and an other end attached to intensifier piston 40 via a rod 45. The side surface of intensifier plunger 43 can move to a position to close bleed off passage 46 during a combustion event. A pair of valve plungers 50 are slidably positioned in plunger bores 23 with one end in contact with the hydraulic fluid in fluid cavity 22 and an other end attached to a yoke 51, which forms part of the over center cam mechanism. A pair of plugs 27 are mounted in hold down pressure plate 26 and act as upward stops for valve plungers 50; and stop ledges 54 (FIG. 2) act as lower stops.

The over center cam mechanism also includes a cam 52 that is rotatable about a pivot pin 53 mounted on yoke 51. A pair of push rods 55 have one end in contact with an outward valve member 30 and an other end in contact with one of the cams 52. A pair of return levers 58 have one end attached to a respective cam 52 and an other end connected to a compression spring 59. Outward valve members 30 are slidably received in guide bores 21 made in actuator body 20, and are biased toward an open position by compression valve opening springs 35.

A force generating device, in this case a solenoid 60, is mounted on actuator body 20 and includes a vertical control rod 61 having a horizontal extension 62 attached thereto. A pair of rollers 63 are mounted on extension 62 and ride against the outside surface of cams 52. Control rod 61 is normally biased to a lower position, as shown, by a solenoid return spring 65. However, when solenoid 60 is energized via a command received from computer 18, which is in communication with and capable of controlling solenoid 60, control rod 61 is pushed upward against the action of solenoid return spring 65.

Figure 2:
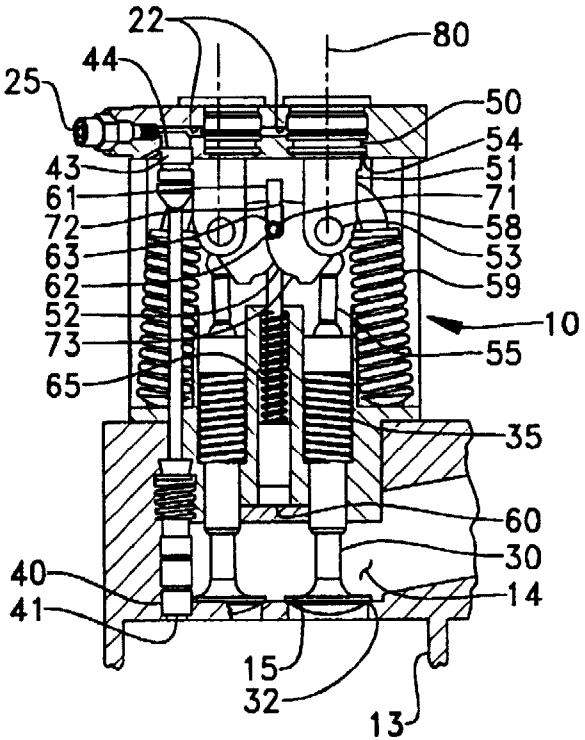
FIG. 2 is a partial sectioned front elevational view of an outwardly opening valve mechanism according to the present invention.

Referring now to FIG. 2, the outwardly opening valve mechanism 10 is shown in its closed and locked position such that the centerline 80 of each valve member 30 is slightly off center but intersects its respective pivot pin 53. Each push rod 55 is substantially aligned with centerline 80, but makes a small angle such that upward forces acting on outward valve member 30 tend to keep cam 52 from rotating about pivot pin 53 toward an opening direction. Outward valve members 30 are forced down against their respective valve seats during a combustion event via the upward force acting on intensifier piston 41 creating hydraulic pressure in fluid cavity 22 via intensifier plungers 43. Note that bleed off passage 46 becomes blocked by intensifier plunger 43 as compression begins in hollow piston cylinder 13 so that fluid cavity 22 is completely closed during a combustion event. Thus, the hydraulic pressure in fluid cavity 22 is transferred into a downward force on valve plungers 50, which is transferred to outward valve members 30 via yoke 51, pivot pin 53, cam 52 and push rod 55. This is possible because valve plungers 50 are lifted off their lower stop ledges 54 by the intervening components when in the locked closed position shown in FIG. 2. The respective hydraulic surfaces are preferably sized to provide a downward force on outward valve members 30 which is greater than the upward force on the outward valve member caused by compression and combustion pressure within hollow piston cylinder 13. In the case shown, the downward force is about 1.2 times the upward force, but this will vary depending upon engine dynamics. Thus, like the prior art, the outward valve members of the present invention are held closed during a combustion event by exploiting the gas pressure within hollow piston cylinder 13. Between combustion events, any losses of hydraulic fluid within fluid cavity 22 are made up by new hydraulic fluid passing through re-supply passage 25. Excess fluid is allowed to escape through bleed off passage 46. The outwardly opening valve mechanism 10 is partially kept in its closed and locked position by the downward force on notches 71 in respective cams 52 supplied by extension 62 of control rod 61 via solenoid return spring 65.

Figure 3:
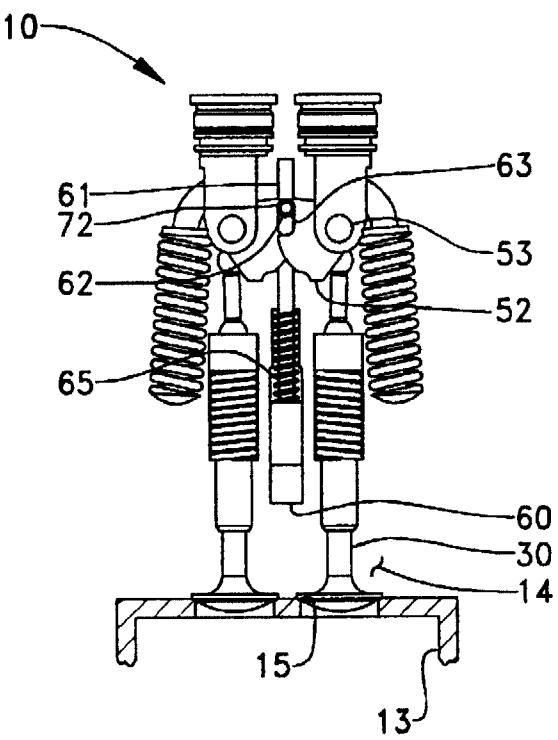
FIG. 3 is a partial sectioned front elevational view of the outwardly opening valve mechanism of FIG. 2, after the valve opening sequence has been initiated.

Referring now to FIG. 3, each valve opening sequence is initiated by energizing solenoid 60 to drive control rod 61 upward against the action of solenoid return spring 65. When this occurs, extension 62 accelerates upward with the rollers 63 running free on the outer surface of cam 52. Upon reaching sufficient speed and momentum, rollers 63 engage opening ramps 72 formed on the outer surface of cam 52, forcing the mechanism out of its locked position and beginning the rotation of the respective cams 52. If the valves shown in the illustrations are used as exhaust valves, residual pressure in the cylinder from the firing stroke of approximately 5% to 10% of the firing pressure will assist compression springs 35 in beginning the upward opening movement of outward valve members 30.

Figure 4:
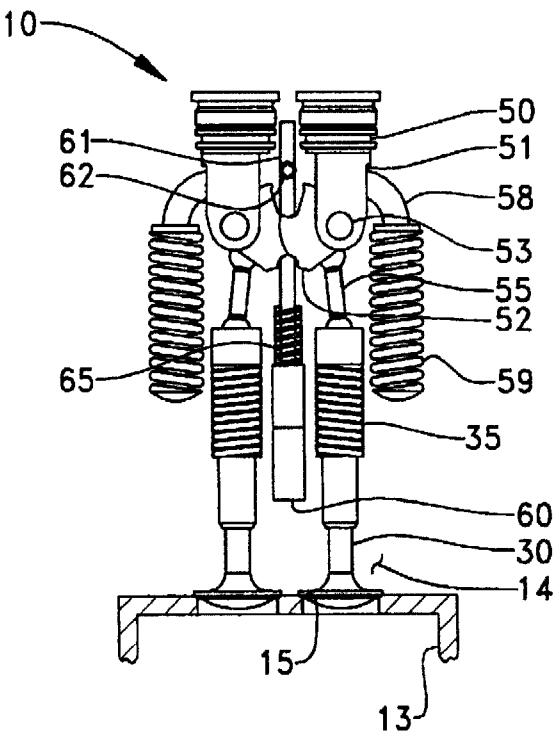
FIG. 4 is a partial sectioned front elevational view of the outwardly opening valve mechanism, showing the valve as it is beginning to open.

Referring now to FIG. 4, after the over center cam mechanism has unlocked, the solenoid and control rod 61 continues its travel to its upper most position, out of contact with cam 52, and is held there with a minimal hold current. Meanwhile, the high pre-load on the valve opening springs 35 plus the residual cylinder pressure (exhaust valves only) accelerates the valves upward, opening port 15 for gas flow from cylinder 13 into gas passageway 14.

Figure 5:
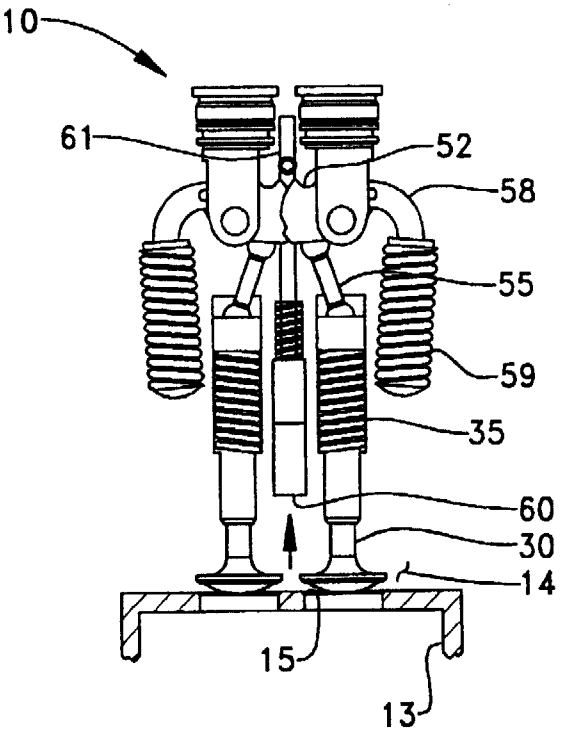
FIG. 5 is partial sectioned front elevational view of the outwardly opening valve mechanism, showing the valve partially open.

Referring now to FIG. 5, as the outward valve members 30 continue to open from the force of valve opening springs 35, the energy of the valve spring pushing on the centered mass 38 (FIG. 1) on the valve member 30, push rod 55, and the over center cam mechanism is transferred to the lever return springs 59 via levers 58. The valve return springs 59 increase in load from a small pre-load as the valve opening springs 35 decrease in load from a high preload.

Concurrently with the opening of valve members 30, the valve plungers 50 are continuously loaded by the hydraulic fluid (oil) pressure in fluid cavity 22. This pressure will push pivot pin 53 toward the hollow piston cylinder 13 as cam 52 rotates out of its locked position. Valve plungers 50 will continue to move downward until its annular stop ledge 54 contacts an annular back stop in pressure plate 26. While valve plungers 50 are moving downward, check valve 28 unseats and allows oil from the re-supply passage 25 to keep fluid cavity 22 full and under pressure. After valve plungers 50 are in their lower most position, hydraulic fluid will continue to pressurize fluid cavity 22 moving intensifier plunger 43 downward toward the hollow piston cylinder 13. This downward movement of intensifier plunger 43 and all of its associated parts will continue until the pressure in fluid cavity 22 balances against the force of compression spring 47 and the cylinder pressure forces on face 41 of intensifier piston 40. The various components associated with the valve plunger loading system will then remain in this position during most of the duration of the valve opening and closing cycle until the valves are again ready to be locked into the closed position.

Figure 7:
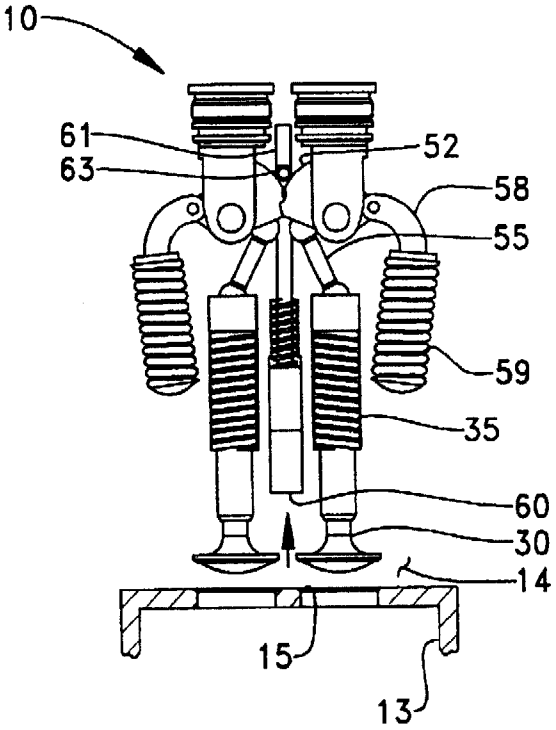
FIG. 7 is partial sectioned front elevational view of the outwardly opening valve mechanism, showing the valve nearly fully opened.
Figure 6:
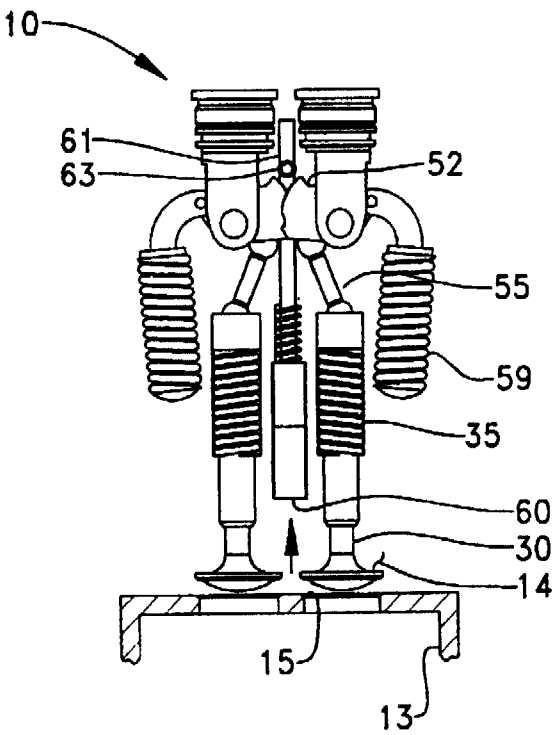
FIG. 6 is partial sectioned front elevational view of an outwardly opening valve mechanism, showing the valve continuing to open.

Referring now to FIG. 6, as the outward valve members continue to open, the respective cams 52 present a constant radius surface to rollers 63. When in this condition, the solenoid current can be switched off. It should be noted that the timing of this de-energization action of solenoid 60 is not critical so long as it occurs during this opening portion of the valve lift. With the solenoid current turned off (FIG. 7), solenoid return spring 65 begins to pull downward on control rod 61 until rollers 63 are again in contact and traveling on the radius portion of cam 52. The valve opening springs 35 are continuing to lose load, while the force build up in the valve return spring 59 is slowing the valve motion acting against the momentum build up in the various parts.

Figure 8:
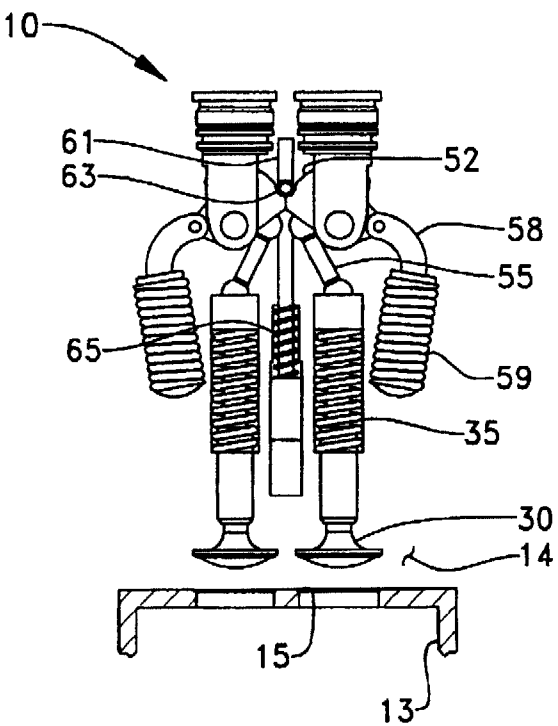
FIG. 8 is partial sectioned front elevational view of an outwardly opening valve mechanism, showing the valve in its locked open position.

Near the maximum rotation of cam 52, a second notch 73 is presented to rollers 63. The solenoid return spring 65 pulls control rod 61 and rollers 63 down into notch 73, locking mechanism 10 and outward valve members 30 in an open position, as shown in FIG. 8. The outward valve members stay open against push rods 55 because of a small retained load in the valve opening springs 35. Roller 63 in notch 73 sets and retains a high load in the valve return springs 59. The mechanism remains in this locked open position for as long as desired during the passage of the exhaust or intake stroke.

Figure 10:
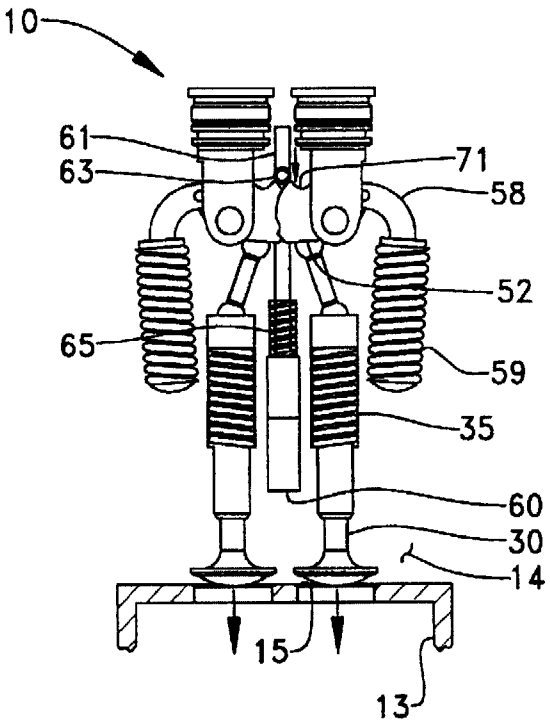
FIG. 10 is partial sectioned front elevational view of an outwardly opening valve mechanism, showing the valves continuing to move toward their closed position.
Figure 9:
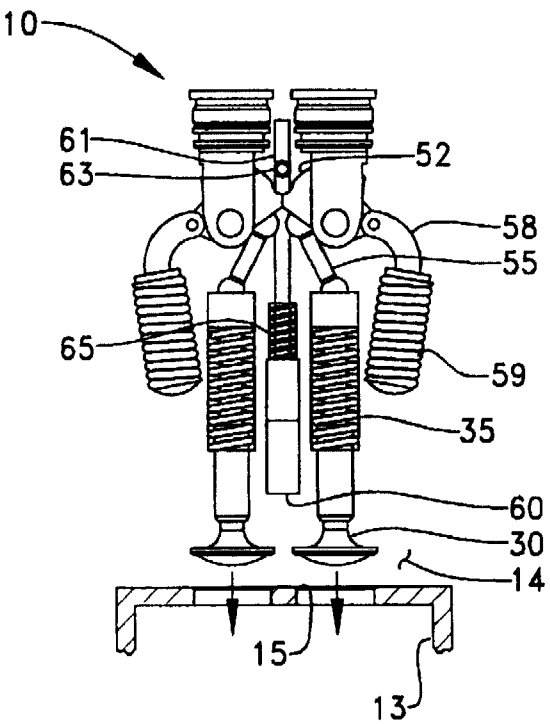
FIG. 9 is partial sectioned front elevational view of the outwardly opening valve mechanism, showing the valve beginning to close.

To close the valves, the solenoid current is again turned on pushing control rod 61 and rollers 63 upward toward their maximum position out of contact with cams 52, as shown in FIG. 9. The high load stored in the valve return springs 59 now accelerates the centered valve mass 38 toward the valve seat, rotating cams 52 about pivot pins 53 in the opposite direction. Referring now to FIG. 10, as the outward valve members 30 continue to shut, the valve return springs 59 pushing the valves is reducing load and the valve opening springs 35 are compressed and increasing in load. Because of friction and inefficiencies in the system, the valve return springs 59 normally have insufficient energy to return the outward valve members 30 to their respective seats. As the valves tend to slow down, the solenoid current is turned off and the energy stored in solenoid return spring 65 pulls control rod 61 and rollers 63 downward, adding its force and energy to the over center cam mechanism when rollers 63 again contact cams 52. The solenoid return spring 65 (and therefore solenoid 60) is sized to provide the energy needed to make up for the losses in the system, and to provide the force necessary to snap the over center cam mechanism into its closed locked position as shown in FIG. 2. As the solenoid return spring 65 continues to drive the valves shut, the over center cam mechanism is eventually pushed into its closed locked condition with valve plungers 50 lifted off lower stop edge 54 and the valve faces of the outward valve members held down in their respective seats, ready for the next compression and firing cycle.

Concurrent with the cam and valves moving into the locked closed position, valve plungers 50 are lifted off stop ledge 54 by the intervening components (yoke 51, cam 52, push rod 55 and outward valve member 30), the check valve 28 will be forced closed, the pressure in fluid cavity 22 is increased, and the fluid volume is decreased. Intensifier plunger 43 and its associated parts are moved further toward hollow piston cylinder 13 to further compress spring 47 and open bleed passage 46 to vent excess fluid. As the cam moves into its locked closed position, the end face 44 of intensifier plunger 43 preferably reaches an equilibrium position in which bleed off passage 46 is barely open to allow any excess hydraulic fluid in fluid cavity 22 to escape back to an engine oil sump (not shown). This ensures that all parameters, including fluid pressure and component positioning, are reset identically before each combustion event. Each combustion event includes a compression and firing cycle. This cycle repeats automatically for each operating cycle of the valves.

Since the valve operating mechanism is center biased to reduce the operating energy to a minimum, the engine shut down and start up cycle is different from a conventional mechanically connected valving mechanism. During normal engine shut down, this device should be shut off in time with the normal engine cycle so that each cylinder's valves are stopped in either the fully locked open or locked closed position. Either position can be made to work, but stopping all the valves at shut down in the locked open position does not require any further design additions. In this position, the oil hydraulic fluid pressure can go to zero and the oil can leak out of the clearances without effecting the valve position and without inhibiting a restart. During start up, the engine is rotated by the starter until oil pressure is achieved with the valves all open and not activating. Once full oil pressure is achieved, fluid cavity 22 is pressurized through the check valve 28 and the electronic signal is sent to the solenoid 60 to initiate valve actuation. Once the valves start, fuel injection is initiated and the engine is started.

The operation of inlet valves is identical to that of exhaust valves except there is no residual pressure in the cylinder to help open the valves. Therefore, the valve must be opened by the valve springs alone and they must therefore be sized to do that. It should be noted that the valve opening springs and valve return springs in the device can be replaced with other types of springs, such as fluid and/or gas accumulators, and still retain the same functionality and structure of the unit. It should also be noted that the solenoid shown in the drawings is only one of several ways of controlling the mechanism. Other force generating devices being considered could include the use of motor drives, pneumatic cylinders and electronically controlled hydraulics, or any force generating device that can provide a time linear motion and can contribute added energy to the system.

INDUSTRIAL APPLICABILITY

Those skilled in the art will appreciate that the attached drawings show that the invention design uses an uncontrolled oil filled pressure piston on top of the mechanism to load the valves onto their respective seats to prevent combustion gas leakage while the valves are closed. The downward force on the valve members is provided by a moveable piston exposed to gas pressure in the combustion chamber of the engine. The valves are opened using an over center device triggered by an electronically controlled actuator, which initiates the timing for the valve opening and valve closing cycles. The valve opening speed is independent of the actuator speed, as it is driven by the residual pressure in the combustion chamber (exhaust valves only) and the force of the valve opening springs. The valve closing speed is controlled by the valve return springs and the solenoid return spring to provide good control of the valve seating velocities. The over center cam mechanism uses a spring centered mass which is free to oscillate between the open and closed positions. This motion alternately compresses and extends the springs which are attached to each end of the mass. Although the drawings illustrate a dual valve mechanism, the same method could be sized to control one valve or to control multiple exhaust or intake valves.

The solenoid operation serves to provide the energy to keep the valve system functioning as well as providing the timing control to the valves for both the opening timing and the closing timing. The described device serves to provide the valving function to open and close the cylinder ports to allow passage of air or combustion gas into or out of a hollow piston cylinder of an engine in proper timing for the engine's combustion cycle. Furthermore, this is accomplished in a way that prevents the possibility of valve to piston contact, which is a constant concern in all electronically controlled valving systems. In other words, since the design allows for the valves to open away from the combustion space, engine failure is prevented in the event that some unforeseen problem leaves the valve in an open position while the piston cycles through top dead center. This type of design should significantly improve the reliability of an engine whose valve motion is not directly geared to the crank shaft.

Other objects and advantages of the present invention will no doubt become apparent to those skilled in the art after a close review of the attached drawings, the appended claims and the above specification.

I claim:

1. An outwardly opening valve system for an engine comprising:

an engine having a hollow piston cylinder in fluid communication with a gas passageway via an opening, and having a piston bore that opens to said hollow piston cylinder;

said opening including an outward valve seat adjacent said gas passageway;

an outward valve member with a valve face;

an intensifier piston positioned in said piston bore with one end contacting gas within said hollow piston cylinder;

a coupling linkage interconnecting said intensifier piston and said outward valve member that includes an over center cam mechanism with a cam rotatable between a closed position in which said valve face of said outward valve member is positioned against said valve seat closing said opening and an open position in which said valve face is away from said valve seat; and a force generating device attached to said engine and having a control rod in contact with said cam over a portion of said cam's rotation between said closed position and said open position.

2. The outwardly opening valve system of claim 1 wherein said cam rotates about a pivot pin; and said force generating device is a solenoid.

3. The outwardly opening valve system of claim 1 wherein said over center cam mechanism further includes a push rod with one end in contact with said outward valve member and an other end in contact with said cam;

said outward valve member moves along a centerline; and said push rod being substantially aligned with said centerline when said cam is in said closed position, but said push rod being at a substantial angle with respect to said centerline when said cam is in said open position.

4. The outwardly opening valve system of claim 1 wherein said force generating device is capable of moving said control rod from a first position to a second position;

a return spring positioned to bias said control rod toward said first position;

said control rod being in contact with a first notch on said cam and holding said cam in said closed position when in said first position; and said control rod being out of contact with said cam when in said second position.

5. The outwardly opening valve system of claim 4 further comprising a valve opening spring in contact with said outward valve member with sufficient strength to bias said cam toward said open position when said cam is in said closed position.

6. The outwardly opening valve system of claim 1 further comprising means for biasing said cam toward said open position when said cam is in said closed position; and means for biasing said control rod toward said first position.

7. The outwardly opening valve system of claim 5 further comprising means, in contact with said cam, for biasing said cam toward said closed position when said cam is in said open position.

8. The outwardly opening valve system of claim 7 wherein said means for biasing said cam toward said closed position includes a return lever attached to said cam and a lever return spring in contact with said return lever.

9. The outwardly opening valve system of claim 4 wherein said cam includes an opening ramp; and said control rod contacts said opening ramp when moving from said first position toward said second position rotating said cam from said closed position toward said open position.

10. The outwardly opening valve system of claim 4 wherein said control rod has a third position between said first position and said second position; and said control rod contacting a second notch on said cam that prevents said cam from rotating toward said closed position.

11. The outwardly opening valve system of claim 1 wherein said coupling linkage further includes:

a valve plunger with one end attached to said outward valve member and another end contacting a hydraulic fluid in a fluid cavity;

an intensifier plunger with one end attached to said intensifier piston and an other end contacting said hydraulic fluid in said fluid cavity.

12. The outwardly opening valve system of claim 11 further comprising:

a re-supply passageway opening to said fluid cavity; and a check valve positioned in said re-supply passageway and being operable to prevent back flow of said hydraulic fluid from said fluid cavity into said re-supply passageway.

13. The outwardly opening valve system of claim 12 further comprising a source of hydraulic fluid connected to said re-supply passageway.

14. The outwardly opening valve system of claim 1 further comprising a computer in communication with and capable of controlling said force generating device.

15. The outwardly opening valve system of claim 1 wherein said control rod includes a roller that rotates along said cam.

16. An outwardly opening valve system for an engine comprising:

an actuator body having a fluid cavity filled with hydraulic fluid that opens to a valve plunger bore, an intensifier plunger bore and a re-supply passageway;

a valve positioned in said re-supply passageway and being operable to prevent back flow of hydraulic fluid from said fluid cavity into said re-supply passageway;

an outward valve member with a valve face positioned to reciprocate in said actuator body;

an intensifier plunger slidably positioned in said intensifier plunger bore with one end in contact with said hydraulic fluid in said fluid cavity and an other end attached to an intensifier piston;

a valve plunger slidably positioned in said valve plunger bore with one end in contact with said hydraulic fluid and an other end in contact with an over center cam mechanism;

said over center cam mechanism including a cam mounted to said actuator body and rotatable about a pivot pin, a push rod with one end in contact with said cam and an other end in contact with said outward valve member, and said pivot pin being attached to said valve plunger;

a force generating device mounted on said actuator body and having a control rod, and said force generating device being capable of moving said control rod between a first position in contact with said cam and a second position away from said cam; and a computer in communication with and capable of controlling said force generating device.

17. The outwardly opening valve system of claim 16 further comprising a return spring with sufficient strength to bias said control rod toward said first position;

said control rod being in contact with a first notch on said cam and holding said cam in a closed position when in said first position; and said control rod being out of contact with said cam when in said second position.

18. The outwardly opening valve system of claim 17 further comprising a valve opening spring in contact with said outward valve member with sufficient strength to bias said cam toward an open position when said cam is in said closed position.

19. The outwardly opening valve system of claim 16 further comprising means for biasing said cam toward said open position; and means for biasing said control rod toward said first position.

20. The outwardly opening valve system of claim 19 further comprising means, in contact with said cam, for biasing said cam toward said closed position when said cam is in said open position.

* * * * *